US009663207B2

(12) United States Patent
Varan

(10) Patent No.: US 9,663,207 B2
(45) Date of Patent: May 30, 2017

(54) PADDLE APPARATUS FOR WATERCRAFT

(71) Applicant: Cyrus O. Varan, Red Beach (NZ)

(72) Inventor: Cyrus O. Varan, Red Beach (NZ)

( * ) Notice: Subject to any disclaimer, the term of this patent is extended or adjusted under 35 U.S.C. 154(b) by 333 days.

(21) Appl. No.: 14/508,537

(22) Filed: Oct. 7, 2014

(65) Prior Publication Data

US 2016/0096605 A1 Apr. 7, 2016

(51) Int. Cl.

| | |
|---|---|
| ***B63H 16/04*** | (2006.01) |
| ***B63H 16/073*** | (2006.01) |
| ***B63H 1/36*** | (2006.01) |

(52) U.S. Cl.

CPC ..... *B63H 16/04* (2013.01); *B63H 1/36* (2013.01); *B63H 16/073* (2013.01); *B63H 2016/046* (2013.01)

(58) Field of Classification Search

CPC ..... B63H 16/00; B63H 16/04; B63H 16/06; B63H 16/10

USPC ..... 440/101, 102, 104, 105, 106

See application file for complete search history.

(56) References Cited

U.S. PATENT DOCUMENTS

| | | | | |
|---|---|---|---|---|
| 2,117,069 | A * | 5/1938 | Musante | B63H 16/04 440/102 |
| 3,677,216 | A * | 7/1972 | Gentemann | B63H 16/04 440/102 |
| 6,890,226 | B2 | 5/2005 | Wang | |
| 7,144,284 | B1 * | 12/2006 | Horan | B63H 16/04 440/102 |
| 7,232,350 | B1 | 6/2007 | Krah | |
| 7,513,808 | B1 | 4/2009 | Murphy | |
| 8,043,134 | B2 | 10/2011 | Krah | |
| 2009/0186536 | A1 | 7/2009 | Murphy | |
| 2010/0151753 | A1 | 6/2010 | Abanto et al. | |
| 2013/0122761 | A1 | 5/2013 | Macias | |
| 2014/0227919 | A1 * | 8/2014 | Radwan | B63H 16/04 440/105 |

* cited by examiner

*Primary Examiner* — Lars A Olson

(74) *Attorney, Agent, or Firm* — Woods Oviatt Gilman LLP; Ronald J. Kisicki, Esq.

(57) ABSTRACT

A propulsion mechanism to propel a watercraft through water comprises paddle bars pivotally attached to a support at a first pivot, the paddle bars having a handle at a first end and a paddled second end. A paddle is pivotally attached to the second end of each paddle bar at a second pivot. When the mechanism is operated through the power stroke, the second pivot end allows the paddle to be supported by the respective paddle bar and to be forcefully driven through the water. When the power stroke is completed, the paddle is permitted to pivot about the second pivot and to disengage the respective paddle bar as the mechanism operates through the return stroke.

20 Claims, 7 Drawing Sheets

PADDLE APPARATUS FOR WATERCRAFT

TECHNICAL FIELD

The present invention relates to watercraft; more particularly, to paddled watercraft; and most particularly, to arm-powered paddled watercraft, including canoes, kayaks, and most especially board-based watercraft such as surfboards, kneeboards, paddleboards and the like.

BACKGROUND OF THE INVENTION

Manual propulsion of a watercraft is known in the art. Manual propulsion of watercraft is generally afforded via one of two methods: the direct use of the user's hands and/or feet; or through the use of one or more paddles. A user's use of the hands and/or feet directly to propel the watercraft generally requires the user to be in a prone position on a surfboard, knee board, etc. The user's arms and/or feet are positioned outside of the body of the board where a traditional swim stroke is employed to propel both the user and the board forward.

A second approach utilizes paddles wherein a paddled end of an oar is dipped into the water and pulled through the water by a canoer or kayaker. Pulling the paddle through the water serves to advance the canoe or kayak across the water's surface. However, in a typical canoe/kayak application, these systems generally require that a user be seated within a vessel and usually only allow paddling from one side of the watercraft at a time. This requires the user to alternate sides of paddling in order to keep the vessel going in a straight line. Thus, every stroke requires the user to lift the paddle completely from the water and pass it over the vessel to transfer it to the other side. This approach is inefficient as only one side of the watercraft is being used for propulsion and energy is wasted by the constant transferring of the paddle.

An alternative paddling approach known in the art includes the provision of a pedal-powered paddle system. These systems are generally situated within a vessel in which the user is in a seated position with the pedals located at the user's feet. The user then generally employs a cycling motion with his or her feet (similar to that used when riding a bicycle) to drive a paddle mechanism. The cycling motion of the paddle mechanism is translated to a paddlewheel situated beneath the surface of the water. As the paddlewheel turns, the watercraft moves through the water.

More recently, the water sport of paddleboarding has gained in popularity. In paddleboarding, a user stands on a board similar to a surfboard and employs a long-handled paddle similar to those used by kayakers. While standing on the paddleboard, the user alternates dipping of the paddle into the water on either side of the paddleboard. Pulling the paddle through the water causes the paddleboard to propel along the water's surface. The alternating swinging of the paddle, along with the pull exerted by the water, makes it difficult for the user to maintain balance, particularly for those initially learning or for those of limited skills. This is coupled to the other drawbacks discussed above, particularly those related to efficiency.

What is needed in the art is an arm-powered apparatus for propelling a watercraft through the water that can be used from a seated or standing position without requiring alternating strokes of a paddle to provide such propulsion. The arm-powered apparatus should further impart a propulsion force from both sides of the vessel during each stroke, but may also be able to allow for selective stroking from only one side of the watercraft so as to enable turning of the watercraft.

SUMMARY OF THE INVENTION

Briefly described, in a mechanism in accordance with the present invention, paddle bars are pivotally attached to a support at a first pivot, each paddle bar having a first handle end and a second paddle end at which a paddle is pivotally attached at a second pivot. When the mechanism is operated through the power stroke, a first end of the paddle is directly engaged with the respective paddle bar. When the power stroke is completed, the paddle is permitted to pivot about the second pivot and to disengage the paddle bar as the mechanism operates through the return stroke.

In accordance with a further aspect of the present invention, the mechanism may further include a paddle bar including a first paddle bar and a second paddle bar. A first bar bracket is pivotally connected to the proximal end of the first paddle bar at a first pivot. A second bar bracket is secured to the distal end of the first paddle bar at a third pivot. The second paddle bar has its proximal end pivotally connected to the first bar bracket at a fourth pivot and its distal end pivotally connected to the second bar bracket at the second pivot. The second paddle bar is maintained in spaced parallel relation with the first paddle bar when the mechanism is operated through the power stroke and the return stroke. A paddle is pivotally connected to the second pivot. When the mechanism is operated through the power stroke, the first and second bar brackets remain generally horizontal. When the power stroke is completed, the paddle is permitted to pivot about the second pivot when the mechanism operates through the return stroke.

In accordance with a further aspect of the invention, the paddle apparatus is mounted onto a user instead of to the watercraft through a mounting frame.

In accordance with a further aspect of the invention, the paddle is rotatably attached to a receiving paddle bar, permitting the paddle to balance the forces across the paddle face through the power stroke.

BRIEF DESCRIPTION OF THE DRAWINGS

The above-mentioned and other features are advantages of this invention, and the manner of attaining them, will become apparent and be better understood by reference to the following description of the invention in conjunction with the accompanying drawings, wherein.

DESCRIPTION OF THE PREFERRED EMBODIMENTS

Figure 1:
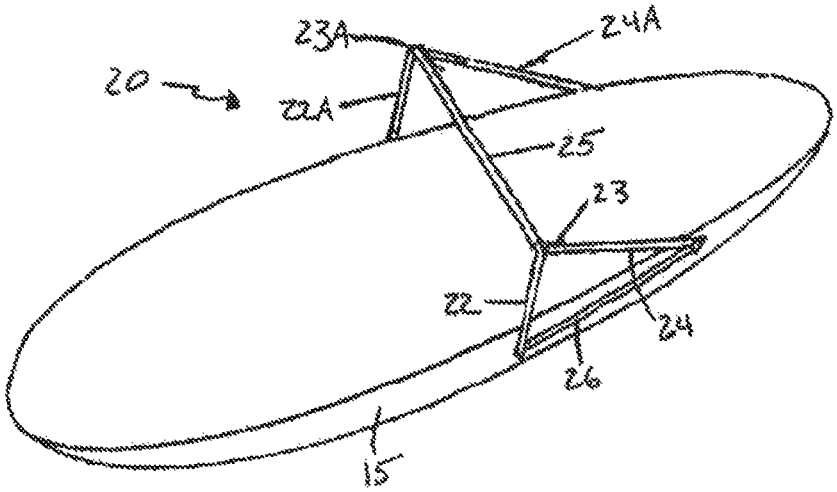
FIG. 1 is a perspective view of a watercraft including a frame unit used in an embodiment of the paddle apparatus in accordance with the invention.

Referring to the drawings in detail, and specifically to FIGS.1-4, reference numeral 110 generally indicates a paddle apparatus according to an embodiment of the present invention. Paddle apparatus 110 generally comprises a frame unit 20 rigidly mounted onto a watercraft 15. Examples of suitable watercraft include canoes, kayaks, surfboards, kneeboards, paddleboards and the like. In accordance with an aspect of the present invention, paddle apparatus 110 is mounted onto a paddleboard or surfboard. Pivotally mounted to the frame unit 20 is a propulsion mechanism 140 which comprises paddle bars 142 and paddle members 150.

Turning now to FIG. 1 specifically, in accordance with embodiment 110 of the paddle apparatus of the present invention, frame unit 20 is comprised of a pair of A-frame supports opposably mounted along respective edges of watercraft 15. Each A-frame has a pair of upright member 22, 24 (22A, 24A) meeting at a common vertex 23 (23A). The opposing end of each upright member is fixedly secured to the watercraft 15. Additionally, cross-bar 26 (26A not shown) may be fixed to the two opposing ends of each upright to provide rigid support to the uprights as well as more surface area with which to secure the A-frame to the watercraft body. A lateral cross member 25 is rigidly mounted between the A-frames and fixedly secures vertex 23 of the first A-frame to vertex 23A of the second A-frame.

Figure 2:
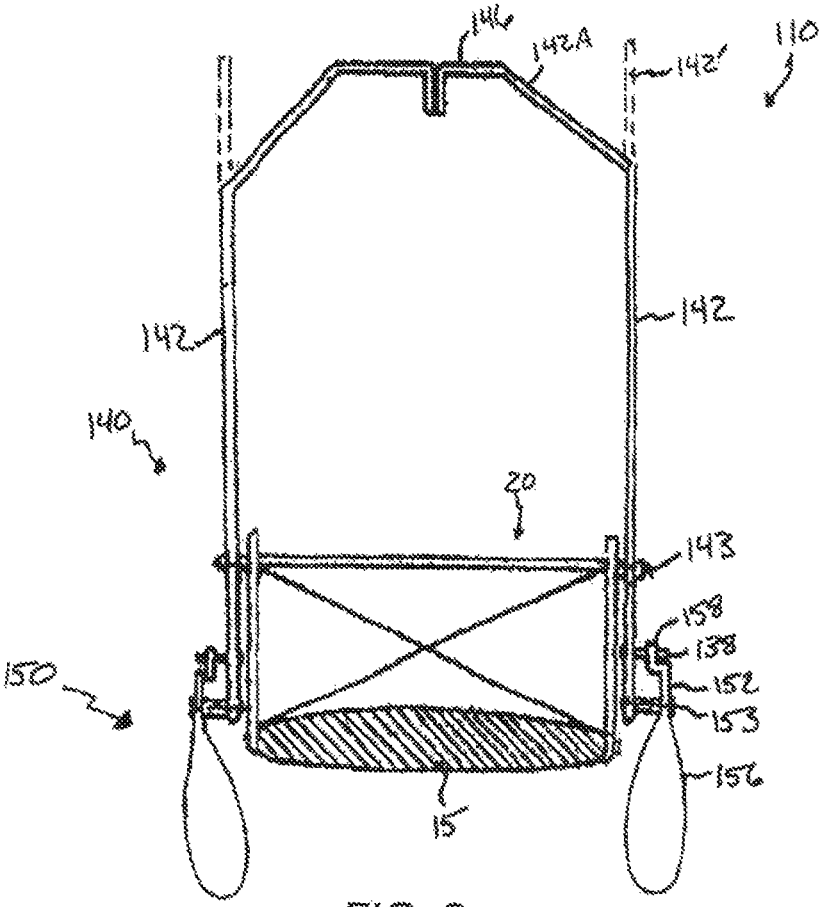
FIG. 2 is an end view of an embodiment of a paddle apparatus in accordance with the invention.
Figure 3:
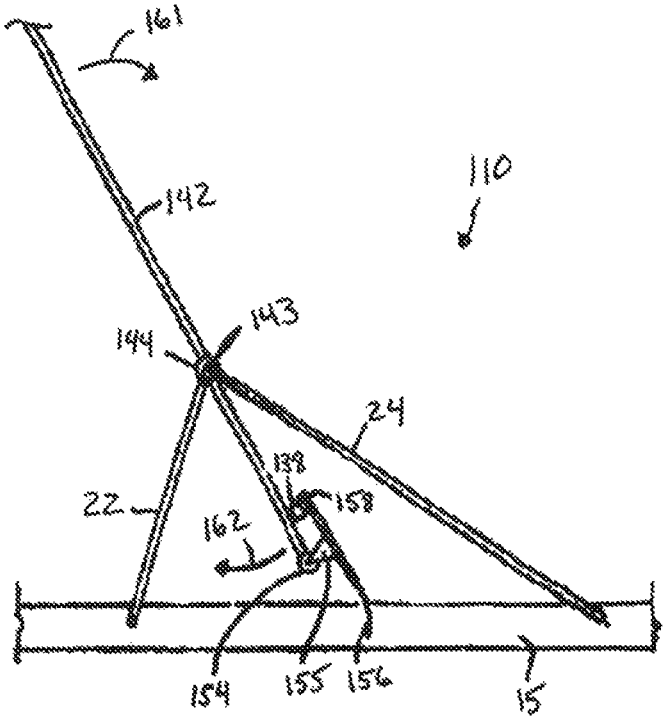
FIG. 3 shows a side view of the embodiment of the paddle apparatus shown in FIG. 2 at the start of a power stroke.
Figure 4:
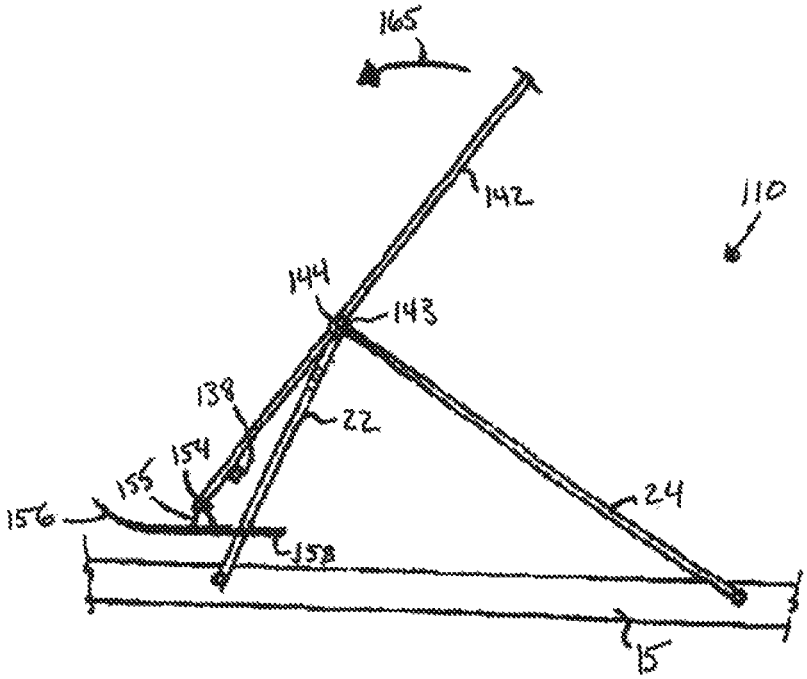
FIG. 4 is a side view of the embodiment of the paddle apparatus shown in FIG. 2 at the start of a return stroke.

Turning now specifically to FIGS. 2-4, embodiment 110 of a paddle apparatus of the present invention generally includes a frame unit 20 mounted along respective edges of watercraft 15. Pivotally mounted to frame unit 20 is propulsion mechanism 140. Propulsion mechanism 140 generally comprises opposing paddle bars 142 operatively coupled to respective paddle members 150. Each paddle bar 142 includes lobe 144 which enables pivotal attachment to frame unit 20 at bar pivot 143. The proximal end of paddle bar 142 is adapted for grasping, such as by terminating in a generally straight bar hold 142' or through a curved handle 146 via bar bend 142A.

Straight bar holds 142' require that each paddle bar 142 be operated independently with the left unit being operated by the user's left arm and with the right unit being operated by the user's right arm. Thus, if one arm is stronger than the other (or otherwise provides a disproportionate paddling force), the watercraft will not move forward in a straight line but will turn in the direction of the greater applied force.

Alternatively, each paddle bar 142 may be configured to include a bar bend 142A terminating in a handle 146. Bar bend 142A of each paddle bar 142 is configured so as to coincide with the other so that the two handles 146 may form a generally contiguous unit. Handles 146 may further include a fixture such as a latch (not shown) wherein the two handles are releasably secured to one another. Thus, when the handles are secured to one another, movement of each paddle member is shared. As such, a user may operate the propulsion mechanism using only his or her left or right arm, or may still use both arms but have any difference in strength equalized by the operation of the joined paddles. However, should the user wish to turn the watercraft, releasing of the latch decouples the two handles form one another. Thus, to turn the watercraft, the user can simply choose to operate one or the other paddle bars 142, depending on the desired turn direction. Once the direction of movement has been changed and straight travel is desired, the opposing handles may be realigned and the latch reengaged so as to once again secure the two paddle bars 142 together.

Figure 5:
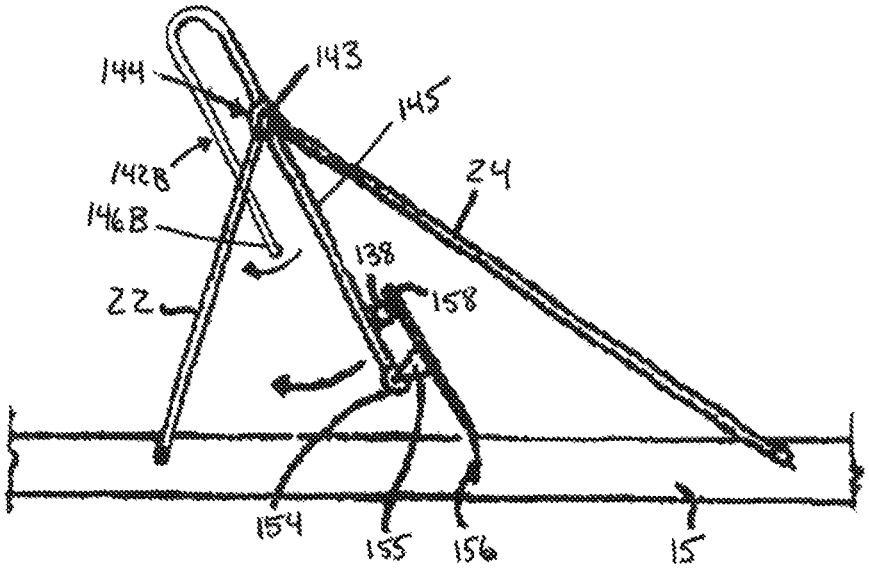
FIGS. 5 and 6 are side views showing variations in the bar to accommodate different paddling positions, in accordance with the invention.
Figure 6:
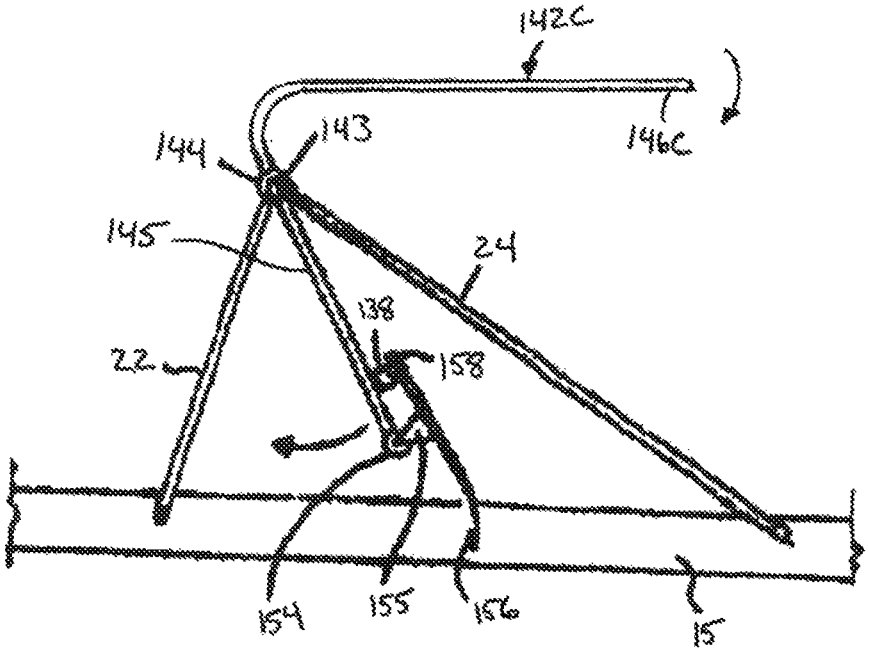

FIGS. 5 and 6 show alternate configurations of paddle bars 142B and 142C. Referring to FIG. 5, paddle bar 142B is formed parallel to main runner 145 so as to dispose handle 146B below pivot 143 so that a user seated to the left of pivot 143 as shown in FIG. 5 must pull handle 146B through the power stroke of the propulsion mechanism. Referring to FIG. 6, paddle bar 142C is formed at an acute angle of main runner 145 so as to dispose handle 146C above pivot 143 so that a user standing to the left of pivot 143 as shown in FIG. 5 must push handle 146C downward through the power stroke of the propulsion mechanism. As can be seen by these two examples, handles 146N can be oriented in any number of ways relative to pivot 143 depending on whether the user is standing or sitting, is to the right or left of the pivot or wishes to pull or push the handles through the power stroke of the propulsion mechanism.

Referring again to FIGS. 2-4, pivotally coupled to each paddle bar 142 at paddle pivot 153 is paddle member 150. Paddle member 150 includes a paddle shaft 152 which terminates at one end in a paddle 156. Paddle 156 is configured to move through the water to propel the watercraft. The other end of paddle member 150 includes paddle end 158 which is adapted to selectively contact a paddle stop 138 secured on paddle bar 142.

Operation of the paddling apparatus 110 is shown generally in FIGS. 3 and 4. FIG. 3 shows a side view of paddle apparatus 110 at the beginning of its power stroke. That is, paddle apparatus 110 is in position for activation of the power stroke such that manual movement of paddle bar 142, as generally indicated by arrow 161, causes the paddle bar 142 to pivot about bar pivot 143. At that point, paddle 156 is powered through the water as generally by arrow 162. Paddle 156 is maintained in its active position shown while paddle end 158 contacts paddle stop 138. Further movement of paddle bar 142 completes the power stroke thereby propelling the watercraft through the water. The power stroke is complete once paddle 156 exits the water.

Once the power stroke has been completed, paddle apparatus 110 is then ready for the return stroke as shown in FIG. 4. In the return stroke, paddle bar 142 is moved in the direction generally indicated by arrow 165, thereby causing a reverse pivot about arm pivot 143. At the completion of the return stroke, the paddle apparatus is returned to the power stroke position as shown in FIG. 3.

To optimize propulsion of apparatus 110, it is imperative to control each paddle's movement on and through the water. That is, moving the paddle through the water during a power stroke serves the intended function of propelling the watercraft forward. However, any such propulsion would be nullified if that paddle were to re-enter the water and travel in the opposing direction during the return stroke. That is, the power stroke and return stroke would effectively cancel one another. Thus, force exerted by the paddle on the water during the return stroke must be reduced, and if possible eliminated.

As best shown in FIGS. 3 and 4, control of the paddle position is afforded by the pivotal relationship between paddle bar 142 and paddle member 150. Specifically, paddle shaft 152 of paddle member 150 is adapted to include a bracket 155 having a bracket lobe 154 which engages pivot 153 situated on the distal end of paddle bar 142. At the start of the power stroke, paddle end 158 of paddle shaft 152 abuts paddle stop 138, due to the force applied to paddle 156 by the surface of the water. As paddle 156 enters the water and is moved through the water on a power stroke, paddle shaft 152 (and paddle 156) is prohibited from pivoting about pivot 153. However, once paddle 156 leaves the water at the end of the power stroke (see FIG. 4), paddle bracket 155 and paddle shaft 152 can pivot about pivot 153 due in part to the force of gravity acting on paddle member 150. Paddle member 150 is then able to pivot freely by the force exerted on paddle 156 by the water as paddle bar 142 is moved through the return stroke. This free movement minimizes the opposing forces of the water on the paddle. Paddle member 150 may then be repositioned at the start of the power stroke wherein paddle end 158 again abuts paddle stop 138. To encourage the effect of gravity acting on paddle member 150, paddle end 158 may be weighted.

While the above recitation of pivoting paddle member 150 may be sufficient to minimize drag of the paddle through the water on the return stroke, it is further envisioned that pivoting of the paddle member may be enhanced by one or more additional features. Pivot 153 may include a biasing member (not shown), such as a torsional spring mounted about pivot 153, to bias paddle end 158 to abut paddle stop 138 when paddle 156 is not impacted by or within the water. Further, paddle stop 138 may releasably secure paddle end 158 in the power stroke position through such interaction as a friction fit or by way of other releasable attachments such as hook-and-loop fastener or magnetic interaction between the paddle stop and the paddle end. In this manner, paddle end 158 can disengage from the paddle stop 138 during the return stroke, but may also help secure the paddle end 158 to paddle bar 142 during the power stroke.

Figure 8:
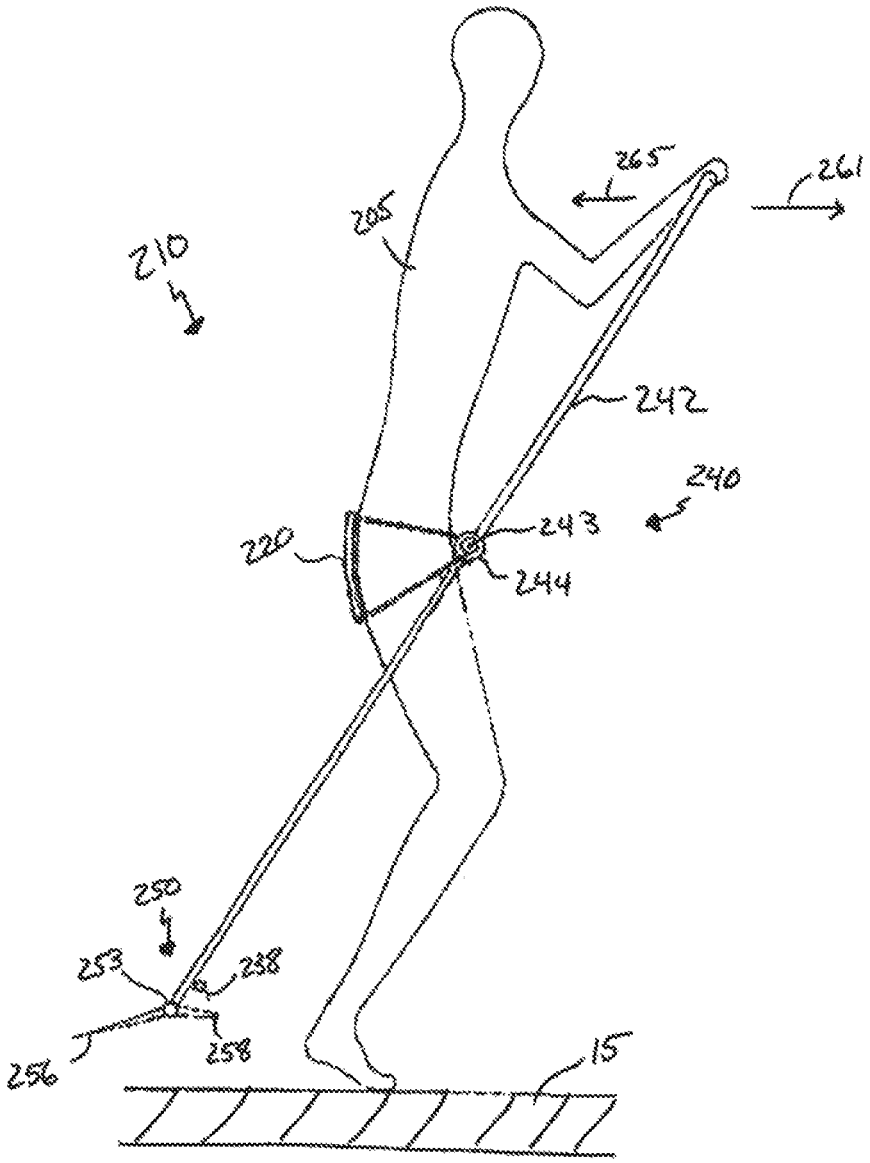
FIG. 8 shows a side view of another embodiment of a paddle apparatus in accordance with the invention.

Turning now to FIG. 8, an alternative embodiment 210 of a paddle apparatus of the present invention is generally comprised of propulsion mechanism 240 pivotally mounted onto a user 205 through a harness 220 rather than through an on-board frame such as frame unit 20 described above with regard to embodiment 110. Propulsion mechanism 240 generally comprises opposing paddle bars 242 operatively coupled to respective paddle members 250. Each paddle bar 242 includes lobe 244 which enables pivotal attachment to harness 220 at bar pivot 243. The proximal end of paddle bar 242 is adapted for grasping, such as by terminating in a generally straight bar hold or through a curved handle similar to those described above, and may include a latch (not shown) to selectively couple the opposing handles together during straight line propulsion.

Pivotally coupled to the distal end of each paddle bar 242 at paddle pivot 253 is paddle member 250. Paddle member 250 may include a paddle body which terminates at one end in a paddle 256. Paddle 256 is configured to impact and to be pulled through the water to propel the watercraft. The other end of paddle member 250 includes paddle end 258 which is adapted to selectively contact a paddle stop 238 secured on paddle bar 242.

Operation of the paddling apparatus 210 may be similar to that of paddle apparatus 110 described above with regard to FIGS. 3 and 4. That is, paddle apparatus 210 may initiate a power stroke by manual pushing of paddle bar 242, as generally indicated by arrow 261, thereby causing paddle bar 242 to pivot about bar pivot 243. Paddle 256 is then powered through the water. Paddle 256 is maintained in its active position while paddle end 258 contacts paddle stop 238. Further pushing of paddle bar 242 completes the power stroke thereby propelling the watercraft through the water. The power stroke is complete once paddle 256 exits the water.

Once the power stroke has been completed, paddle apparatus 210 is then ready for the return stroke. In the return stroke, paddle bar 242 is pulled toward the user in the direction generally indicated by arrow 265, thereby causing a reverse pivot about arm pivot 243. At the completion of the return stroke, the paddle apparatus is returned to the power stroke position.

As has been described previously, to optimize propulsion of apparatus 210, it is imperative to control each paddle's movement on and through the water. That is, pushing the paddle through the water during a power stroke serves the intended function of propelling the watercraft forward. However, any such propulsion would be nullified if that paddle were to re-enter the water and travel in the opposing direction during the return stroke. That is, the power stroke and return stroke would effectively cancel one another. Thus, force exerted by the paddle on the water during the return stroke must be reduced, and if possible eliminated.

As shown in FIG. 8, control of paddle member 250 is afforded by the pivotal relationship between paddle bar 242 and paddle member 250. Specifically, paddle member 250 is adapted to engage with pivot 253 situated on the distal end of paddle bar 242. At the start of the power stroke, paddle end 258 abuts paddle stop 238, for instance due to the force applied to paddle 256 by the water. As paddle 256 enters the water and is moved through the water on a power stroke, paddle member 250 is prohibited from pivoting about pivot 253 due to its engagement with paddle stop 238. However, once paddle 256 leaves the water at the end of the power stroke, paddle member 250 can pivot about pivot 253. Paddle member 250 is then able to pivot freely as it is moved through the return stroke. This free movement minimizes the opposing forces of the water on the paddle. Paddle member 250 may then be repositioned at the start of the power stroke wherein paddle end 258 again abuts paddle stop 238.

While the above recitation of pivoting paddle member 250 may be sufficient to minimize drag of the paddle through the water on the return stroke, it is further envisioned that pivoting of the paddle member may be enhanced by one or more additional features. Similar to those features described above with regard to embodiment 110, paddle stop 238 may releasably secure paddle end 258 in the power stroke position through such interaction as a friction fit or by way of other releasable attachments such as hook-and-loop fastener or magnetic interaction between the paddle stop and the paddle end. In this manner, paddle end 258 can freely disengage from the paddle stop 238 during the return stroke, but may also help secure the paddle end 258 to paddle bar 242 during the power stroke. Further, pivot 253 may include a biasing member (not shown) as discussed in regard to embodiment 110.

Figure 9:
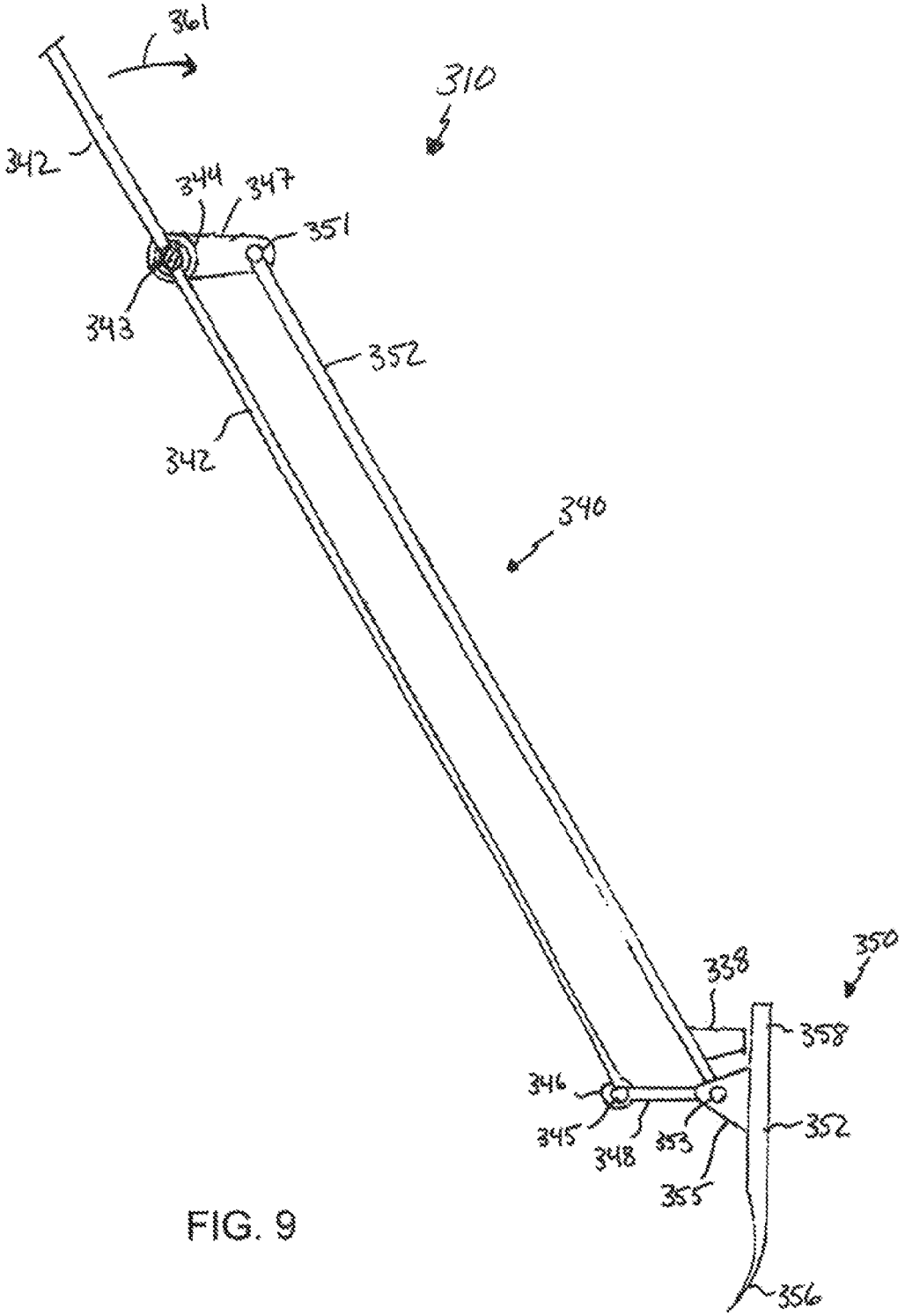
FIG. 9 shows a side view of a propulsion mechanism that may be utilized within a paddle apparatus in accordance with the invention.
Figure 10:
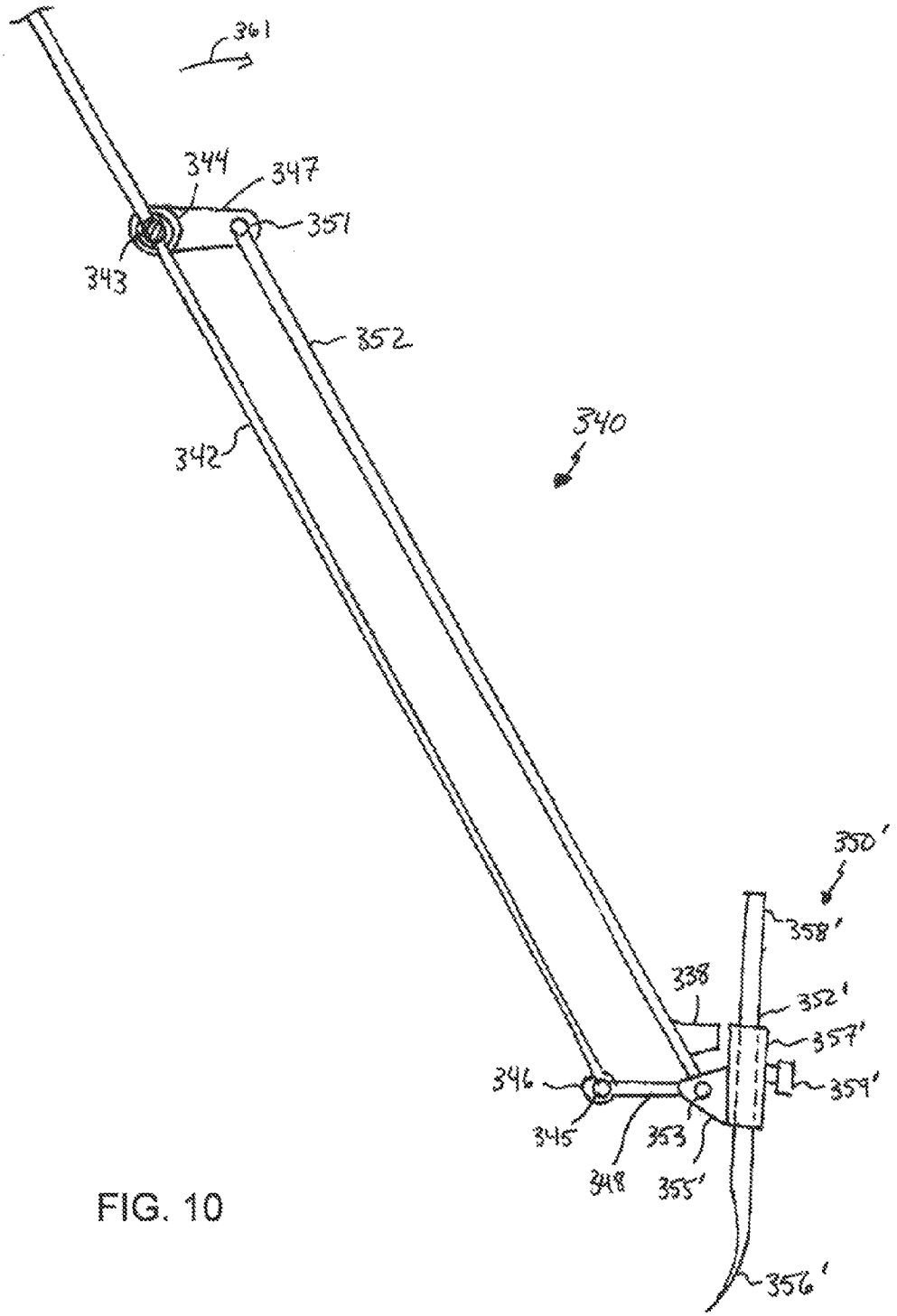
FIG. 10 shows a side view of an alternative propulsion mechanism that may be utilized within a paddle apparatus in accordance with the invention.

Turning now to FIGS. 9 and 10, further embodiments of a propulsion mechanism 340 for use within a paddle apparatus 310 are shown. Propulsion mechanism 340 includes bar pivot 343 which may be mounted onto a board-mounted frame such as frame 20 discussed above with regard to embodiment 110 or may be mounted onto a user-worn harness such as harness 220 described above with regard to embodiment 210.

As shown in FIGS. 9 and 10, first bar bracket 347 is pivotally secured to bar pivot 343 (and frame unit 20 or harness 220). Further mounted to bar pivot 343 is first paddle bar 342 via lobe 344. Second paddle bar 352 is pivotally mounted onto the opposing end of first bar bracket 347 at pivot 351. The proximal end of first paddle bar 342 is adapted for grasping, such as by terminating in a generally straight bar hold or through a curved handle similar to those described above, and may include a latch (not shown) to selectively couple the opposing handles together during straight line propulsion. The distal end of first paddle bar 342 and second paddle bar 352 are each pivotally connected to opposing ends of second bar bracket 348 at pivots 345 and 353, respectively. The distances between pivots 343 and 351 and between pivots 345 and 353 are the same so as to form an articulated parallelogram, defined by first paddle bar 342, second bar bracket 348, second paddle bar 352 and first bar bracket 347.

FIG. 9 shows propulsion mechanism 340 including a pivotally mounted fixed paddle member 350. Paddle member 350 includes a paddle shaft member 352 which terminates at one end in paddle 356. Paddle 356 is configured to impact and to be moved through the water to propel the watercraft. The other end of paddle member 350 includes paddle end 358 which is adapted to selectively contact paddle stop 338 secured on second paddle bar 352. Paddle shaft 352 of paddle member 350 is configured to include bracket 355 which pivots about pivot 353. Paddle stop 338 is proportioned to place paddle member 350 and paddle 356 in a generally vertical orientation during the power stroke which is generally indicated by arrow 361. Thus, as paddle 356 is drawn through the water on the power stroke, second bar bracket 348 will remain generally horizontal as shown (that is, parallel with the surface of the water). And, because the distances between pivots 343 and 351, and between pivots 345 and 353 that form the articulating parallelogram are the same, first bar bracket 347 also remains generally horizontal during the power stroke. At the end of the power stroke when propulsion mechanism 340 transitions to the return stroke, paddle member 350 pivots about pivot 353 from the force of the water applied to paddle 356, thereby reorienting paddle member 350 to lie in a more horizontally oriented plane. Paddle member 350 thus remains in a more horizontal orientation throughout the return stroke due to the force of the water on paddle 356.

Turning now to FIG. 10, propulsion mechanism 340 (or mechanisms 110 or 210) can be further modified to include a pivotally mounted adjustable paddle member 350'. Similar to paddle member 350, paddle member 350' includes a paddle shaft 352' which terminates at one end in a paddle 356'. Paddle 356' is configured to impact and to be pulled through the water to propel the watercraft. The other end of paddle member 350' includes paddle end 358' which is adapted to selectively contact paddle stop 338 secured on second paddle bar 352 such that operation of propulsion mechanism 340 is similar to that described above with regard to paddle member 350. However, unlike paddle member 350, paddle member 350' is configured to be slidably positionable about pivot 353. By an adjustment feature. The adjustment feature may include a bracket 355' and paddle sleeve 357'. Paddle sleeve 357' is proportioned to slidably engage paddle shaft 352' such that the watercraft user can selectively control the penetration depth of paddle 356' into the water and thereby improve the efficiency in which the paddle apparatus moves the watercraft through the water. Locking device 359' then secures paddle shaft 352' at the desired location within paddle sleeve 357'.

Figure 7:
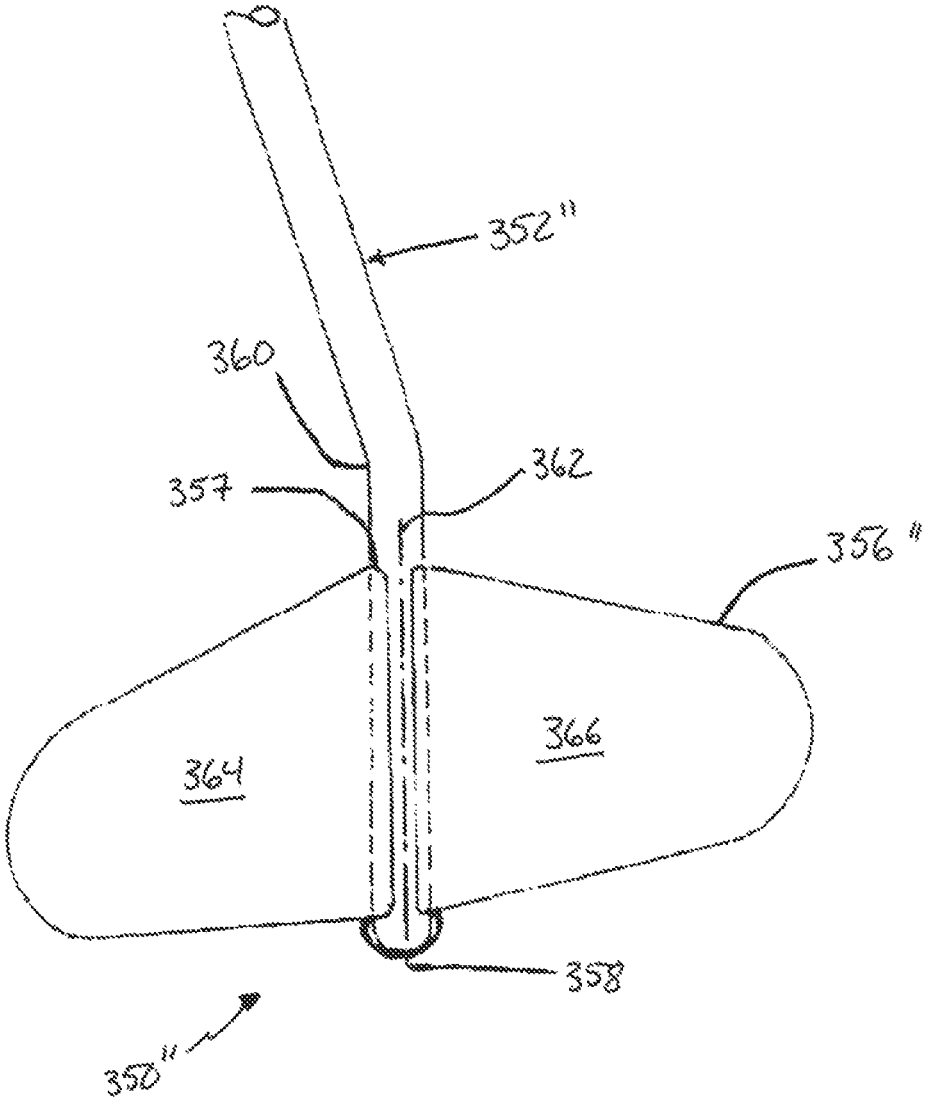
FIG. 7 shows a view of an alternate embodiment of the paddle member where the paddle is permitted to pivot about a vertical axis.

Referring now to FIG. 7, an alternate embodiment of the paddle member shown in FIGS. 2-6 and 8-10 is provided. Instead of paddle member 150, 250, 350 and 350' being rigidly attached to the paddle bar, paddle 356" of paddle member 350" is provided with a rotating feature that allows the lateral length (L) to rotate about paddle bar 352". The rotating feature may include bar channel 357 for receiving paddle bar 352". The bar and channel are sized so that paddle 356" slidably receives paddle bar 352", thereby permitting the paddle to rotate freely about axis 362 on the end of the paddle bar. The paddle is secured to the paddle bar by a retention feature, such as for example a ball 358 formed on the end the paddle bar. Retention feature 358 and bar bend 360 hold the rotatable paddle 356" in place at the end of paddle bar 352". By giving the paddle the freedom to rotate about axis 362, the forces imparted on the paddle blades 364 and 366 through the power stroke are balanced across the paddle and are directed perpendicularly on the paddle blades, thereby further improving the efficiency in which the paddle apparatus moves the watercraft through the water.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A propulsion mechanism to propel a watercraft through water, wherein the mechanism is operated through a power stroke to propel the watercraft through the water, and through a return stroke to return the mechanism to a starting point of the power stroke, the mechanism comprising:

a) a first bar member pivotally attached to a support at a first pivot, wherein the support comprises a frame unit including a top end and a bottom end, wherein the bottom end is configured to mount the frame unit onto the watercraft, and wherein the frame unit is configured as an A-frame; and b) a paddle member having a first end and a paddled second end and pivotably attached to a distal end of the first bar member at a second pivot, wherein when the mechanism is operated through the power stroke, the first end of the paddle member is directly engaged with the first bar member, and wherein when the power stroke is completed, the paddle member is permitted to pivot about the second pivot and to disengage the first end of the paddle member from the first bar member when the mechanism operates through the return stroke.

2. The mechanism in accordance with claim 1 wherein the first bar member further includes a paddle stop, the paddle stop configured to engage the first end of the paddle member when the mechanism is operated through the power stroke.

3. The mechanism in accordance with claim 1 further including a biasing member configured for biasing the first end of the paddle member toward the first bar member.

4. A propulsion mechanism to propel a watercraft through water, wherein the mechanism is operated through a power stroke to propel the watercraft through the water, and through a return stroke to return the mechanism to a starting point of the power stroke, the mechanism comprising:

a) a first bar member pivotally attached to a support at a first pivot, wherein the support includes a harness worn by a user, and wherein the first pivot is located proximate a hip of the user;

b) a paddle member having a first end and a paddled second end and pivotably attached to a distal end of the first bar member at a second pivot, wherein when the mechanism is operated through the power stroke, the first end of the paddle member is directly engaged with the first bar member, and wherein when the power stroke is completed, the paddle member is permitted to pivot about the second pivot and to disengage the first end of the paddle member from the first bar member when the mechanism operates through the return stroke.

5. The mechanism in accordance with claim 1 wherein a proximal end of the first bar member is configured for grasping.

6. The mechanism in accordance with claim 1 wherein the frame unit comprises a pair of A-frame members.

7. The mechanism in accordance with claim 6 wherein at least one lateral cross member is rigidly mounted between the A-frame members.

8. The mechanism in accordance with claim 1 wherein the propulsion mechanism includes respective first and second first bar members, wherein a proximal end of the respective first bar members are coupled together to form a contiguous bar unit.

9. The mechanism in accordance with claim 8 wherein the contiguous bar unit includes a latch for selectively decoupling the respective first bar members from each other so that one or the other first bar member may be selectively operated through the power stroke to enable turning of the watercraft.

10. The mechanism in accordance with claim 1 wherein the first end of the paddle member is weighted.

11. The mechanism in accordance with claim 1 wherein the paddle member further includes a paddle bracket and wherein the paddle bracket is pivotally attached at the second pivot.

12. The mechanism in accordance with claim 11 wherein the paddle member is configured to be slidably secured to the second pivot point.

13. The mechanism in accordance with claim 5 wherein the first bar member is configured to dispose the proximal end of the first bar member below the first pivot whereby a user may operate the propulsion mechanism through the power stroke from a seated position.

14. The mechanism in accordance with claim 5 wherein the first bar member is configured to include an acute angle so as to dispose the proximal end of the first bar member above the first pivot whereby a user may operate the propulsion mechanism through the power stroke by pushing downwardly on the proximal end of the first bar member.

15. The mechanism in accordance with claim 1 wherein the paddled second end includes a lateral length and is rotatably attached to said paddle bar so that is lateral length of said paddled second end is permitted to rotate about an axis of said paddle bar.

16. The mechanism in accordance with claim 15 wherein the paddled second end includes a bar channel, the bar channel adapted to slidably receive the paddle bar.

17. The mechanism in accordance with claim 15 wherein the paddled second end is rotatably secured between a bar bend and a retention feature on the paddle member.

18. A propulsion mechanism to propel a watercraft through water, wherein the mechanism is operated through a power stroke to propel the watercraft through the water, and through a return stroke to return the mechanism to a starting point of the power stroke, the mechanism comprising:

a) a first bar member pivotally attached to a support at a first pivot, wherein the first bar member includes a distal end;

b) a first bar bracket secured to the support, wherein the first bar member is pivotally connected to the first bar bracket at the first pivot;

c) a second bar bracket secured to the distal end of the first bar member at a second pivot;

d) a second bar member having a proximal end and a distal end, wherein the proximal end is pivotally connected to the first bar bracket at a third pivot, and wherein the distal end is pivotally connected to the second bar bracket at a fourth pivot; and e) a paddle member including a first end and a paddled second end, wherein the paddle member is pivotably attached to the second bar bracket and the distal end of the second bar member at the fourth pivot, wherein the second bar member is maintained in spaced parallel relation with the first bar member when the mechanism is operated through the power stroke and the return stroke, wherein when the mechanism is operated through the power stroke the first end of the paddle member is directly engaged with the second bar member, and wherein when the power stroke is completed, the paddle member is permitted to pivot about the fourth pivot and to disengage the first end of the paddle member from the second bar member when the mechanism operates through the return stroke.

19. The mechanism in accordance with claim 18 wherein the paddle member further includes a paddle bracket, and wherein the paddle bracket is pivotally attached at the fourth pivot.

20. The mechanism in accordance with claim 19 wherein the paddle member is configured to be slidably secured to the fourth pivot point.

* * * * *